US007690224B1

(12) United States Patent
Wei

(10) Patent No.: US 7,690,224 B1
(45) Date of Patent: Apr. 6, 2010

(54) YARN CHANGING SET FOR COLOR ALTERING HEADS

(75) Inventor: Chih-Liang Wei, Yilan County (TW)

(73) Assignee: Pai Lung Machinery Mill Co., Ltd., Taipei Hsien (TW)

( * ) Notice: Subject to any disclaimer, the term of this patent is extended or adjusted under 35 U.S.C. 154(b) by 0 days.

(21) Appl. No.: 12/557,148

(22) Filed: Sep. 10, 2009

(30) Foreign Application Priority Data

Dec. 29, 2008 (TW) ..... 97223540 U

(51) Int. Cl.
*D04B 27/10* (2006.01)

(52) U.S. Cl. ..... 66/140 R

(58) Field of Classification Search ..... 66/140 R, 66/125 R, 134–139, 142
See application file for complete search history.

(56) References Cited

U.S. PATENT DOCUMENTS 4,656,842 A * 4/1987 Sawazaki et al. ..... 66/139
5,070,709 A * 12/1991 Guell ..... 66/140 R
6,000,245 A * 12/1999 Plath et al. ..... 66/139
6,408,655 B1 * 6/2002 Ossensi et al. ..... 66/140 R
6,655,176 B1 * 12/2003 Wang ..... 66/140 R
7,036,343 B1 * 5/2006 Wei ..... 66/140 R
7,055,348 B1 * 6/2006 Wei ..... 66/140 R
2006/0010928 A1 * 1/2006 Traenkle et al. ..... 66/133

* cited by examiner

*Primary Examiner*—Danny Worrell
(74) *Attorney, Agent, or Firm*—Muncy, Geissler, Olds & Lowe, PLLC

(57) ABSTRACT

A yarn changing set for color altering heads includes a yarn splint plate, a movable cutter plate, a yarn cutting plate and a yarn changing plate positioned in an overlapped manner. A plurality of pins are coupled between the yarn splint plate and yarn cutting plate to allow the movable cutter plate and yarn changing plate to move between them. The movable cutter plate and yarn changing plate have respectively a notch at one edge opposing each other to form a confined area to limit movement of the pins when driven by a cam. The yarn cutting plate has a plurality of notches on the edges to hold the pins. Thus an open type design is formed to expose cotton accumulating portions to facilitate clearing of accumulated cotton. Therefore, smooth operation can be maintained and life span of the machine and elements increases.

9 Claims, 8 Drawing Sheets

YARN CHANGING SET FOR COLOR ALTERING HEADS

FIELD OF THE INVENTION

The present invention relates to a color altering head for circular knitting machines that has a movable cutter plate and a yarn changing plate adopted an open type design.

BACKGROUND OF THE INVENTION

A circular knitting machine aims to knit fabrics of varying colors and patterns. It has a rotary circular disc with radial cams and actuators at the bottom and a plurality of color altering heads located below. Each color altering head has a plurality of yarn changing sets. During operation, each actuator selects one yarn changing set of the color altering head and the cam pushes a movable cutter plate and a yarn changing plate in the yarn changing set to move alternately to drive a yarn to a yarn feeding port to switch yarns of different colors.

Refer to FIGS. 1 and 2 for a conventional structure. It includes a color altering head 1 with a plurality of yarn changing sets 12 (four sets are shown in the drawings) located between two splint plates 11. Each yarn changing set 12 has a yarn changing plate 121, a yarn cutting plate 122, a movable cutter plate 123 and a yarn splint plate 124. The yarn cutting plate 122 and the yarn splint plate 124 have a plurality of holes 1221 and 1241 coupling with a plurality of pins 125. The movable cutter plate 123 and yarn changing plate 121 have respectively confining slots 1211 and 1231 in the center. The movable cutter plate 123 is movably interposed between the yarn cutting plate 122 and yarn splint plate 124. The yarn changing plate 121 is located outside the yarn cutting plate 122. The pins 125 in the center run through the confining slots 1211 and 1231. The pins 125 located on the periphery butt the edges of the movable cutter plate 123 and yarn changing plate 121 to confine moving direction of the movable cutter plate 123 and yarn changing plate 121 so that the movable cutter plate 123 and yarn changing plate 121 can be moved reciprocally to crochet and cut a yarn. The yarn cutting plate 122 also has another two confining slots 1222 at one side.

When the circular knitting machine operates for a time period, the reciprocal yarn movement generates cotton which gradually accumulates between the yarn cutting plate 122 and yarn splint plate 124, and also in the confining slots 1211 and 1231 of the yarn changing plate 121 and movable cutter plate 123. Operation becomes unsmooth. Even elements could be damaged. Hence a periodic repair and maintenance have to be performed after a period of time. Due to the color altering head 1 adopts a closed design, all elements have to be disassembled during repair and maintenance. This is time consuming and results in lengthy operation interruption. There are still rooms for improvement.

SUMMARY OF THE INVENTION

Therefore, the primary object of the present invention is to provide an open type transmission deign of the yarn changing set for color altering heads to facilitate removing of cotton accumulated inside and maintain smooth operation and increase life span.

To achieve the foregoing object, the present invention provides a plurality of yarn changing sets between two splint plates. Each yarning changing set includes a yarn splint plate, a movable cutter plate, a yarn cutting plate and a yarn changing plate. There are a plurality of pins located between the yarn splint plate and yarn cutting plate. The movable cutter plate is interposed between the yarn splint plate and yarn cutting plate. The yarn changing plate is located outside the yarn cutting plate. The movable cutter plate and yarn changing plate are movably between the pins. By disposing the pins at two edges of a neck of the movable cutter plate and yarn changing plate, a harness and confining effect is formed. The movable cutter plate and yarn changing plate also have respectively a notch at opposing edges to surround the pins when the movable cutter plate and yarn changing plate are located opposite. The yarn cutting plate also has a notch at one edge to hold the pins.

During operation, a cam pushes the yarn changing plate and movable cutter plate up and down alternately to change yarns between the yarn changing sets. With the pins butting two symmetrical edges of the yarn changing plate and the neck of the movable cutter plate, the movable cutter plate and yarn changing plate can be pushed by the cam between the yarn splint plate and yarn cutting plate in a confined sway and sliding fashion reciprocally. Moreover, during assembly and installation, the pins and other elements are not confined to closed apertures, but form an open type transmission. The cotton accumulating portions are exposed outside, thus can be easily cleared through high pressure air to maintain smooth operation of the circular knitting machine. The life span of the machine also increases.

The foregoing, as well as additional objects, features and advantages of the invention will be more readily apparent from the following detailed description, which proceeds with reference to the accompanying drawings.

DETAILED DESCRIPTION OF THE PREFERRED EMBODIMENT

Figure 3:
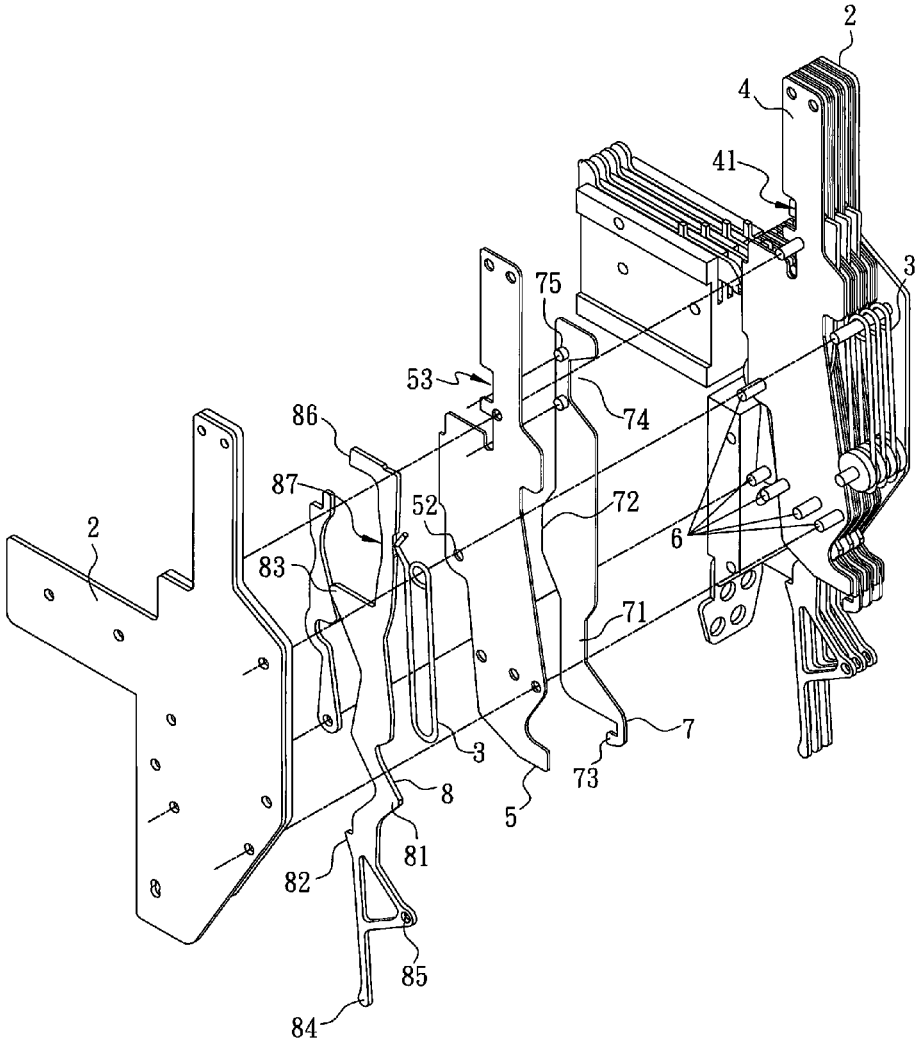
FIG. 3 is an exploded view of an embodiment of the invention.
Figure 4:
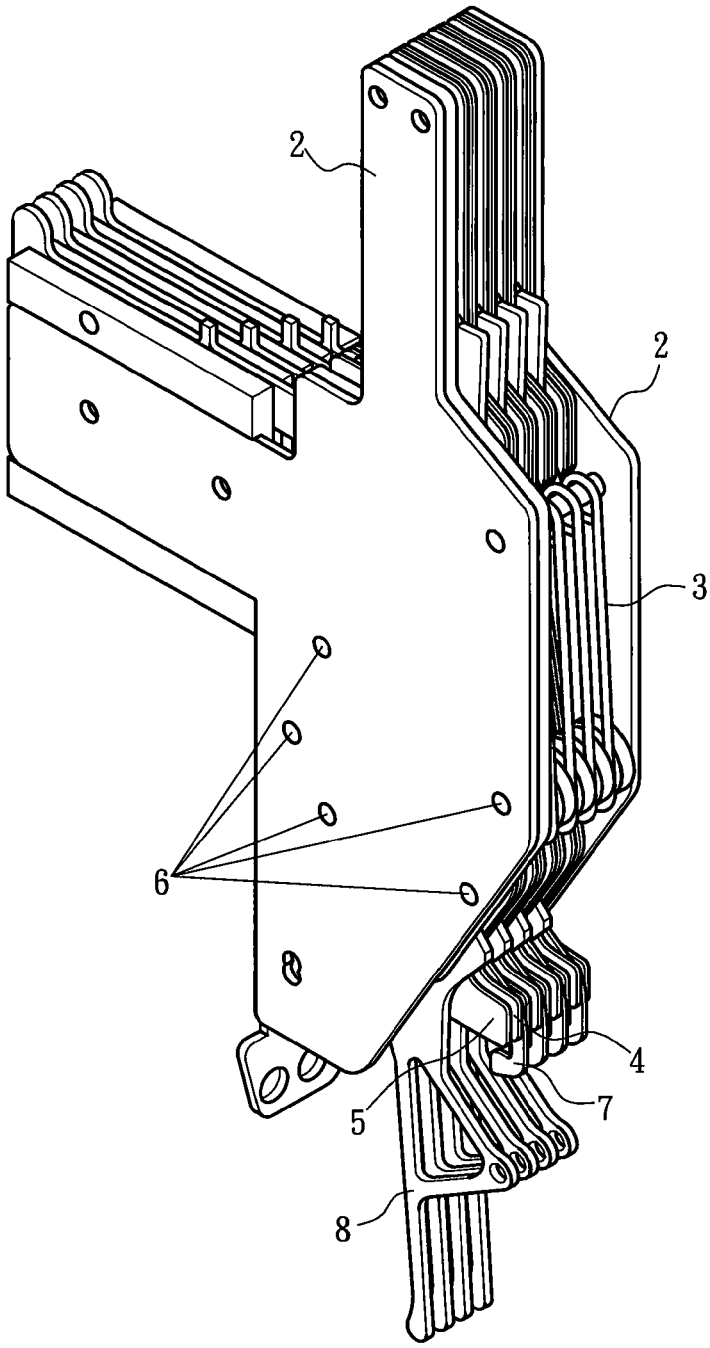
FIG. 4 is a perspective view of an embodiment of the invention.
Figure 5:
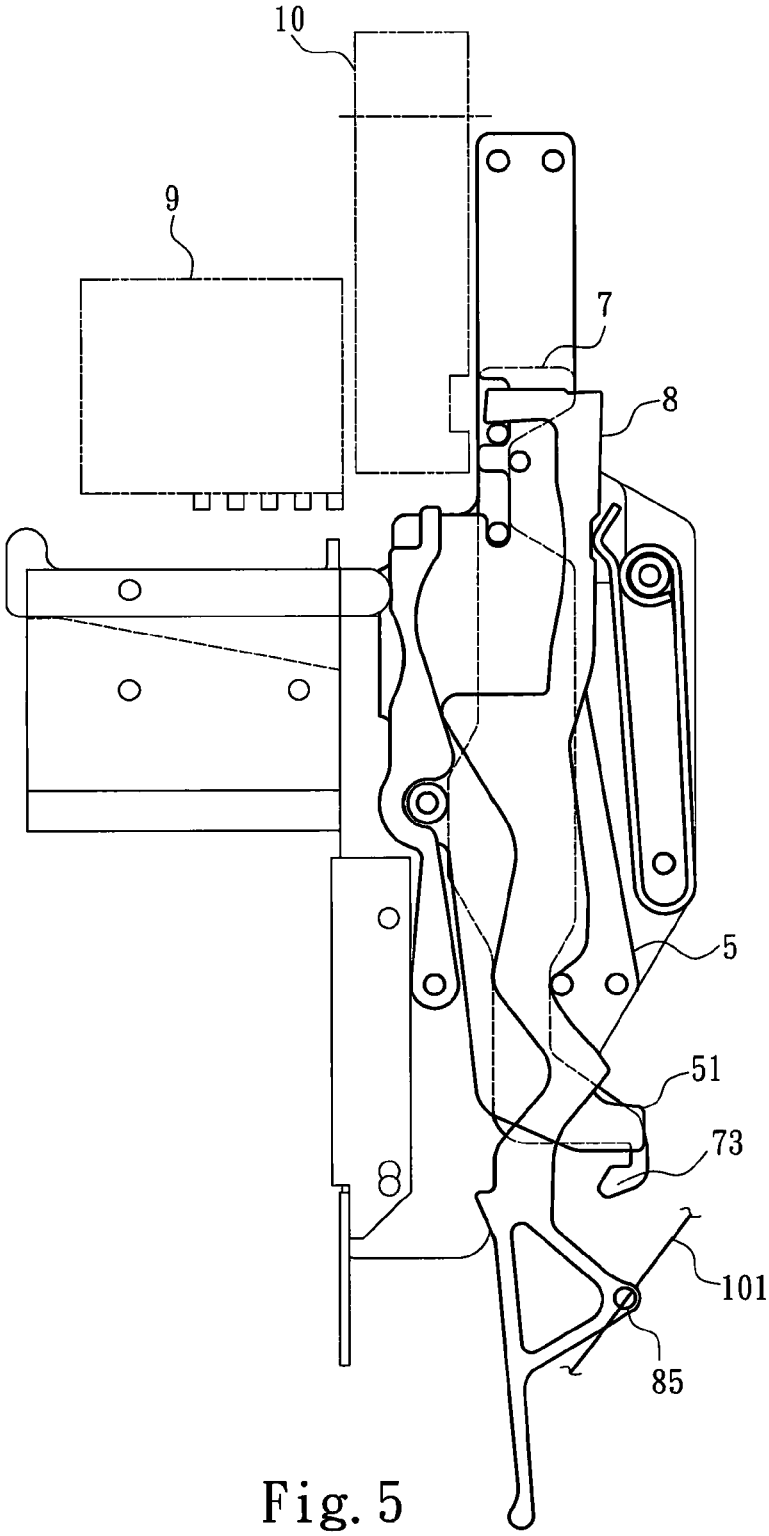
FIG. 5 is a schematic view of operating condition-1 of an embodiment of the invention.
Figure 6:
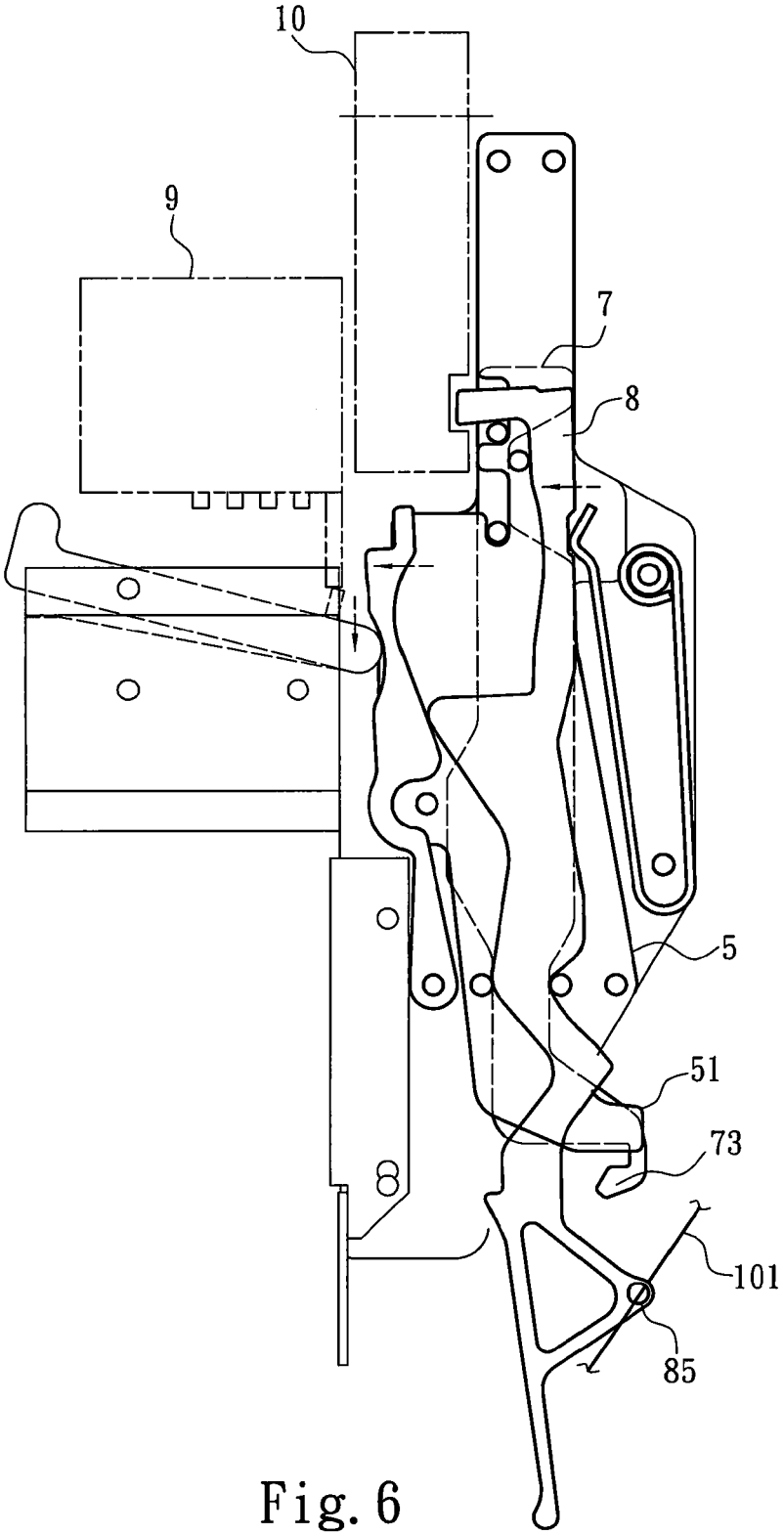
FIG. 6 is a schematic view of operating condition-2 of an embodiment of the invention.
Figure 7:
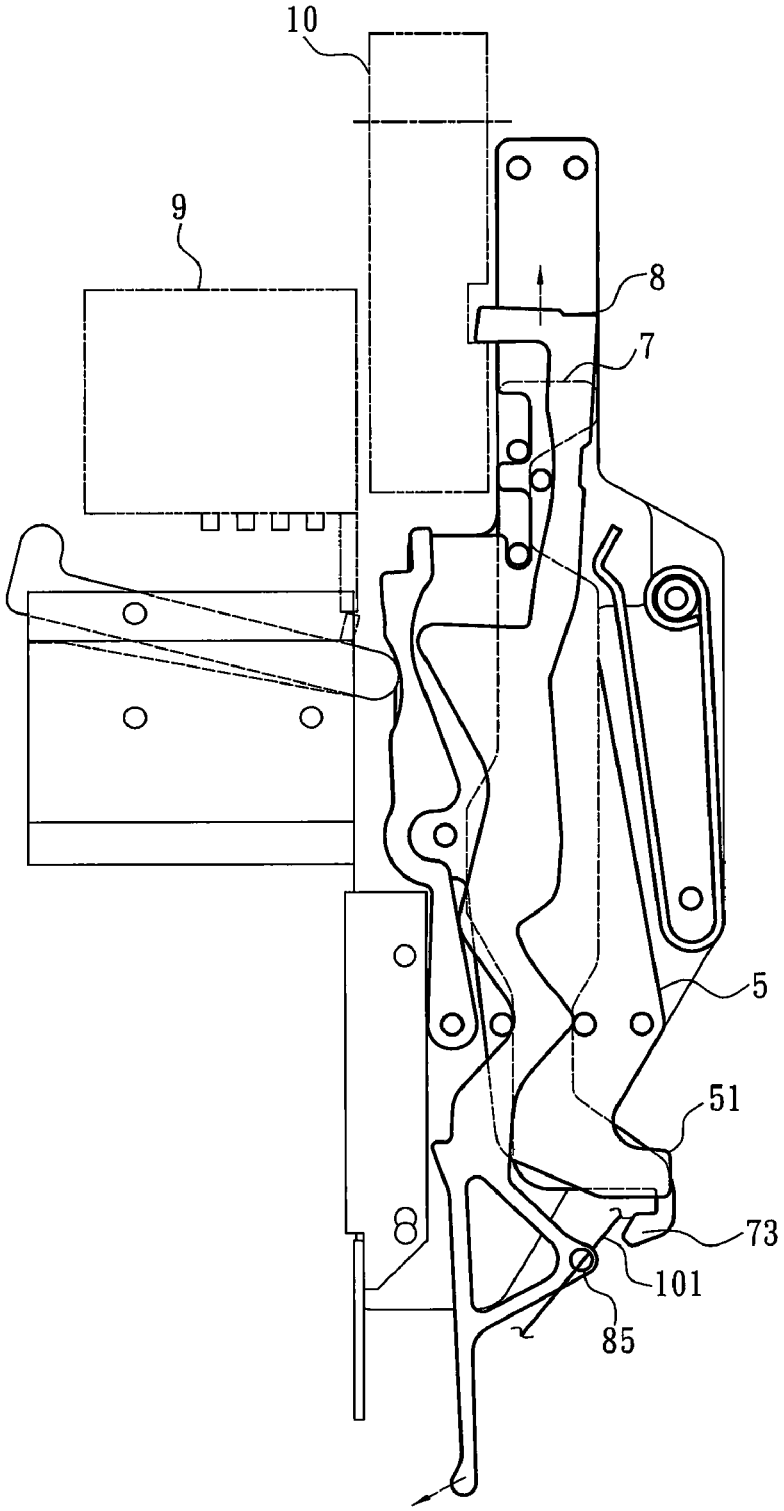
FIG. 7 is a schematic view of operating condition-3 of an embodiment of the invention.
Figure 8:
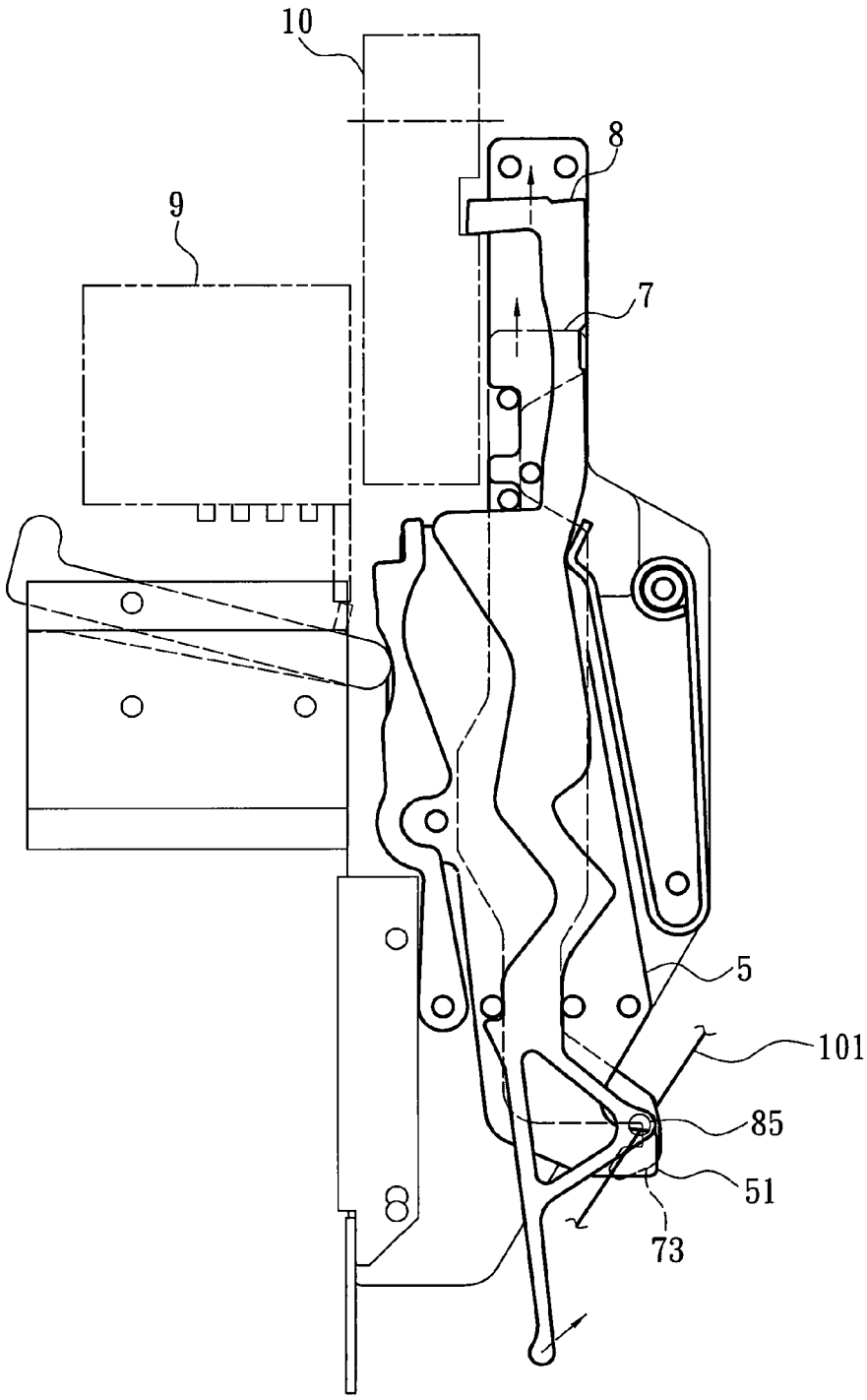
FIG. 8 is a schematic view of operating condition-4 of an embodiment of the invention.

Please refer to FIGS. 3 and 4, the yarn changing set of the present invention is provided in multiple numbers (four sets are shown in the drawings) between two splint plates 2. A plurality of elastic elements 3 are provided on the left side of the splint plates 2 with one end butting some elements of the invention. The invention includes:

a yarn splint plate 4 formed in a flat plate with two confining slots 41 formed at one edge of an upper end of a left side;

a yarn cutting plate 5 also formed in a flat plate and located at one side of the yarn splint plate 4 with a yarn cutting portion 51 at one end and a plurality of apertures 52 formed on the plane thereof. The yarn splint plate 4 and each of the apertures 52 are respectively coupled with a pin 6. The yarn cutting plate 5 further has two other confining slots 53 formed at one edge of an upper end of the left side thereof;

a movable cutter plate 7 being a flat plate with a neck 71 and movably interposed between the yarn splint plate 4 and yarn cutting plate 5. The neck 71 is movable between two symmetrical pins 6 which butt two lateral edges of the neck 71. As shown in the drawings, the movable cutter plate 7 leans onto the yarn cutting plate 5 with a first leaning portion 72 jutting outwards from a left edge. The first leaning portion 72 is protrusive in the center and has two trapezoidal sloped edges at two sides. The movable cutter plate 7 further has a hook 73 at a bottom end and a first notch 74 at a top end. The first leaning portion 72 and the first notch 74 are located at two edges of the movable cutter plate 7. Thus the movable cutter plate 7 can be moved reciprocally in a confined manner between the yarn splint plate 4 and yarn cutting plate 5. Moreover, the movable cutter plate 7 has the top end run through by two pins 75 which are held in the confining slots 53 of the yarn cutting plate 5; and a yarn changing plate 8 which is a flat plate with a V-shaped tortuous portion 81 in the center and located outside the yarn cutting plate 5. The tortuous portion 81 is movably located between two symmetrical pins 6 which butt two lateral edges of the tortuous portion 81. The tortuous portion 81 has a jutting inverse hook 82 at a lower side and a second leaning portion 83 at an upper side. The yarn changing plate 8 further has a poking rod 84 and a yarn threading hole 85 at the bottom, and a third leaning portion 86 and a second notch 87 at the top end. The second leaning portion 83 is triangular with one corner jutting outwards and one side perpendicular to the second notch 87. The third leaning portion 86 has one side formed an angle with a lateral side of the second notch 87 smaller than 90 degrees. Therefore, the yarn changing plate 8 can be moved reciprocally in a confined sway and movement fashion.

Figure 1:
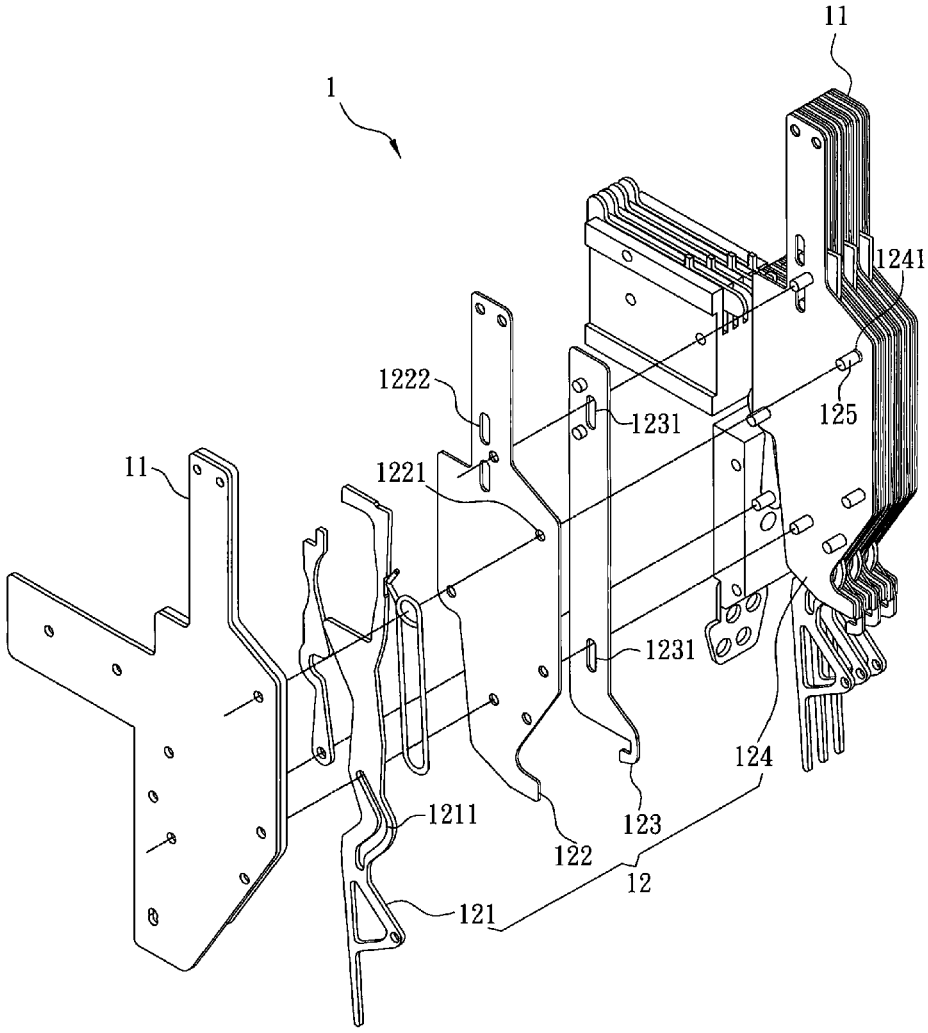
Fig. 1 PRIOR ART
FIG. 1 is an exploded view of a conventional yarn changing set of a color altering head.
Figure 2:
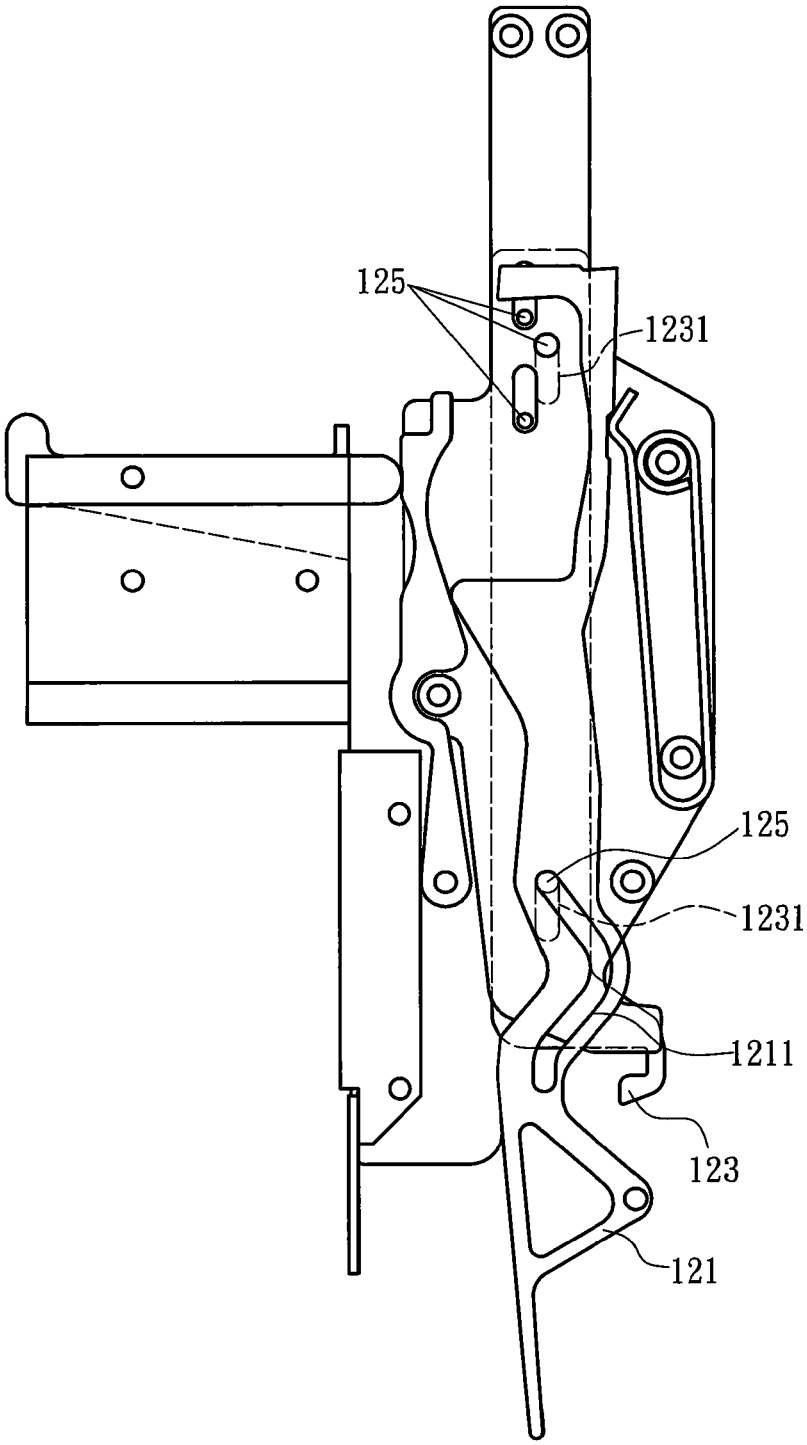
Fig. 2 PRIOR ART
FIG. 2 is a schematic view of a conventional yarn changing set of a color altering head in an operating condition.

For assembly and installation of the invention, the first notch 74 of the movable cutter plate 7 and the second notch 87 of the yarn changing plate 8 are positioned opposing each other to form a confined movement space of the pins 6. The symmetrical pins 6 at the bottom of the yarn splint plate 4 and yarn cutting plate 5 are located at two edges of the neck 71 of the movable cutter plate 7 and the tortuous portion 81 of the yarn changing plate 8 to confine the movement range of the movable cutter plate 7 and the yarn changing plate 8. Moreover, the elastic element 3 at the right side of the splint plate 2 butts the edge of the yarn changing plate 8 to keep the yarn changing plate 8 at a desired position during moving. While the invention does not provide the pins 125 and confining slots 1211, 1222 and 1231 to confine transmission as the conventional technique does shown in FIG. 1, through the first notch 74, the second notch 87 and the pins 6, and the neck 71 and the tortuous portion 81 and the symmetrical pins 6, an open type transmission design is formed. Hence normal operation can be maintained. During repair and maintenance, high pressure air can be used to quickly clear and remove the accumulated cotton and keep the interior of the yarn changing sets in a clean condition. As a result, a smooth operation can be maintained, and total life span increases.

Referring to FIGS. 2, and 5 through 8, when in use, an actuator 9 switches a selected yarn changing set; a cam 10 at the bottom of the circular disc pushes the movable cutter plate 7 and yarn changing plate 8 downwards; the yarn changing plate 8 also sways leftwards during moving downwards to drive a yarn 101 threaded through the yarn changing plate 8 to move and sway concurrently to finish yarn changing operation. To switch to another yarn, the yarn 101 threaded through the yarn changing plate 8 is moved upwards and hooked by the hook 73 of the movable cutter plate 7; the yarn changing plate 8 and movable cutter plate 7 are moved synchronously upwards, and the yarn cutting portion 51 of the yarn cutting plate 5 cuts off the yarn to finish the yarn changing operation.

As previously discussed, referring to FIGS. 3 through 8, during implementation of the invention, the neck 71 and first notch 73 of the movable cutter plate 7, and the tortuous portion 81, second leaning portion 83, third leading portion 86 and second notch 87 of the yarn changing plate 8 and pins 6 are deployed and positioned in an open type transmission design. The cotton accumulated inside can be cleared easily to maintain smooth operation. The life span of the machine and elements also can be lengthened. It provides a significant improvement over the conventional techniques.

While the preferred embodiment of the invention has been set forth for the purpose of disclosure, modifications of the disclosed embodiment of the invention as well as other embodiments thereof may occur to those skilled in the art. Accordingly, the appended claims are intended to cover all embodiments which do not depart from the spirit and scope of the invention.

What is claimed is:

1. A yarn changing set for color altering heads, comprising:

a flat yarn splint plate;

a flat yarn cutting plate which is located at one side of the yarn splint plate and has a plurality of confining slots on an upper end at one edge, a yarn cutting portion at a lower end, and a plurality of apertures, the yarn splint plate and apertures of the yarn cutting plate being respectively coupled with pins;

a movable cutter plate which is located between the yarn splint plate and the yarn cutting plate and has a neck in the center, a first leaning portion at one edge jutting outwards, two ends formed respectively a hook and a first notch; the first leaning portion and the first notch being located at two lateral edges of the movable cutter plate; the movable cutter plate further having a plurality of pins on one side adjacent to the first notch; and a yarn changing plate which is located outside the yarn cutting plate and has a V-shaped tortuous portion in the center, and one lateral edge adjacent to two sides of the tortuous portion to form a jutting inverse hook and a second leaning portion, a poking rod and a yarn threading hole at a lower end and a third leaning portion and a second notch at an upper end.

2. The yarn changing set for color altering heads of claim 1, wherein the yarn splint plate and the yarn cutting plate are formed in a same shape.

3. The yarn changing set for color altering heads of claim 1, wherein the first notch of the movable cutter plate is disposed opposing to an opening of the second notch of the yarn changing plate.

4. The yarn changing set for color altering heads of claim 1, wherein the first leaning portion is protrusive in the center and has two sloped sides formed respectively in a trapezoidal shape.

5. The yarn changing set for color altering heads of claim 1, wherein the second leaning portion is triangular and has one corner jutting outwards and one side perpendicular to the second notch.

6. The yarn changing set for color altering heads of claim 1, wherein the third leaning portion has one side formed an angle with one lateral side of the second notch smaller than 90 degrees.

7. The yarn changing set for color altering heads of claim 1 further having two pins respectively located at two sides of the neck of the movable cutter plate and the tortuous portion of the yarn changing plate to confine movement thereof.

8. The yarn changing set for color altering heads of claim 1, wherein the pins on the movable cutter plate are movably disposed in other confining slots formed on the yarn splint plate.

9. The yarn changing set for color altering heads of claim 1, wherein multiple yarn changing sets located between two splint plates which have one side is disposed of a plurality of elastic elements which butt an edge of the yarn changing plate.

* * * * *